US009502190B2

(12) United States Patent
Fujita et al.

(10) Patent No.: US 9,502,190 B2
(45) Date of Patent: Nov. 22, 2016

(54) SWITCH

(71) Applicant: OMRON Corporation, Kyoto-shi, Kyoto (JP)

(72) Inventors: Hiroyuki Fujita, Okayama (JP); Kenichi Ando, Okayama (JP); Kenji Kuroki, Okayama (JP)

(73) Assignee: OMRON Corporation, Kyoto (JP)

( * ) Notice: Subject to any disclaimer, the term of this patent is extended or adjusted under 35 U.S.C. 154(b) by 92 days.

(21) Appl. No.: 14/217,687

(22) Filed: Mar. 18, 2014

(65) Prior Publication Data

US 2014/0284195 A1 Sep. 25, 2014

(30) Foreign Application Priority Data

Mar. 19, 2013 (JP) ..... 2013-057187

(51) Int. Cl.

| | |
|---|---|
| ***H01H 1/36*** | (2006.01) |
| ***H01H 13/14*** | (2006.01) |
| ***H01H 1/40*** | (2006.01) |
| ***H01H 13/12*** | (2006.01) |
| ***H01H 13/18*** | (2006.01) |

(52) U.S. Cl.

CPC ..... *H01H 13/14* (2013.01); *H01H 1/36* (2013.01); *H01H 1/365* (2013.01); *H01H 1/40* (2013.01); *H01H 13/12* (2013.01); *H01H 13/186* (2013.01)

(58) Field of Classification Search

CPC ..... H01H 1/40; H01H 2001/406
USPC ..... 200/550, 252, 253
See application file for complete search history.

(56) References Cited

U.S. PATENT DOCUMENTS

2009/0095609 A1 4/2009 Ruff
2013/0206565 A1 8/2013 Pabst et al.

FOREIGN PATENT DOCUMENTS

DE 102007048581 B3 9/2008
EP 2006868 * 12/2008

(Continued)

OTHER PUBLICATIONS

Extended European Search Report for Application No. 14157267.7, mailed on Jul. 7, 2014 (7 pages).

(Continued)

*Primary Examiner* — Renee Luebke
*Assistant Examiner* — Ahmed Saeed
(74) *Attorney, Agent, or Firm* — Osha Liang LLP

(57) ABSTRACT

A switch has a normally-closed fixed contact unit, a common contact unit, a pressing member, and a movable contact that is attached to the pressing member, and that slides on the normally-closed fixed contact unit and the common contact unit. A conductive region and an insulating region are formed on a sliding surface of the movable contact in the normally-closed fixed contact unit in order toward a pressing direction of the pressing member. A conductive region and an insulating region are formed on a sliding surface of the movable contact in the common contact unit in order toward the pressing direction. The movable contact slides from the conductive regions to the insulating regions to switch from a closed state to an opened state.

6 Claims, 8 Drawing Sheets

(56) References Cited

FOREIGN PATENT DOCUMENTS

| | | | |
|---|---|---|---|
| EP | 2006868 | A2 | 12/2008 |
| GB | 2318694 | A | 4/1998 |
| JP | S60-35426 | U | 3/1985 |
| JP | 3001279 | U | 8/1994 |
| JP | H08-227630 | A | 9/1996 |
| JP | H09-147652 | A | 6/1997 |
| JP | 2005-019139 | A | 1/2005 |
| JP | 3956806 | B2 | 8/2007 |
| JP | 2009-004175 | A | 1/2009 |
| JP | 2012-138221 | A | 7/2012 |
| WO | 2011154202 | A1 | 12/2011 |

OTHER PUBLICATIONS

Notification of Reasons for Refusal issued in corresponding Japanese Application No. 2013-057187, mailed on Jul. 26, 2016 (8 pages).

* cited by examiner

SWITCH

BACKGROUND OF THE INVENTION

1. Technical Field

The present invention relates to a switch.

2. Related Art

Conventionally, there is well known a switch that is turned on and off by sliding a slider, which is of a movable contact retained by an operating member, on a fixed contact in response to a lever operation.

The conventional switches are disclosed in Japanese Unexamined Patent Publication Nos. 2009-4175, H8-227630, 2012-138221, and 2005-19139 and Japanese Patent No. 3956806. In these switches, the switch that switches a circuit from a closed state to an opened state by performing a pressing operation includes a normally-closed fixed contact having a conductive region and an insulating region as the fixed contact. The circuit is switched from the closed state to the opened state by sliding the slider from the conductive region to the insulating region of the fixed contact.

However, unfortunately an insulation failure is generated with increased number of repetitive opening and closing movement in the conventional switch, which includes the normally-closed fixed contact and switches the circuit from the closed state to the opened state by sliding the slider that is of the movable contact on the normally-closed fixed contact.

In the conventional switch, the slider slides on the conductive region and the insulating region of the normally-closed fixed contact during the opening and closing operation. The repetitive opening and closing movement abrades the conductive region, and metallic abrasion powders are deposited on the conductive region and the insulating region. FIG. 9 is a photograph illustrating the metallic abrasion powders deposited on a sliding surface of the slider in the normally-closed fixed contact. As a result, insulation performance of the switch degrades to generate the insulation failure.

An arc discharge is generated between the normally-closed fixed contact and the slider in the case of the opening and closing operation of a high-capacity current. An insulating resin or a grease, which constitutes the insulating region, is carbonized, and therefore the insulation performance of the switch degrades to generate the insulation failure.

SUMMARY

One or more embodiments of the present invention provides a switch in which the insulation failure is hardly generated.

In accordance with one or more embodiments of the present invention, a switch includes: a normally-closed fixed contact unit; a common contact unit; a pressing member; and a movable contact that is attached to the pressing member and is configured to slide on the normally-closed fixed contact unit and the common contact unit. In the switch, a conductive region and an insulating region are sequentially formed toward a pressing direction of the pressing member in a sliding surface of the movable contact in the normally-closed fixed contact unit, a conductive region and an insulating region are sequentially formed toward the pressing direction in a sliding surface of the movable contact in the common contact unit, and the movable contact is configured to slide from the conductive region to the insulating region to switch from a closed state to an opened state.

According to one or more embodiments of the present invention, the conductive region and the insulating region are sequentially formed toward the pressing direction of the pressing member in the sliding surface of the movable contact in the normally-closed fixed contact unit, and the conductive region and the insulating region are sequentially formed toward the pressing direction in the sliding surface of the movable contact in the common contact unit. Therefore, an insulation distance necessary to close a circuit is a distance in which a sliding distance of the movable contact in the insulating region of the normally-closed fixed contact unit and a sliding distance of the movable contact in the insulating region of the common contact unit are added to each other. When compared with the conventional switch, the insulation distance can be lengthened by the sliding distance of the movable contact in the insulating region of the common contact unit. Therefore, when compared with the conventional switch, the insulation performance is improved and the insulation failure is hardly generated.

According to one or more embodiments of the present invention, a current opening and closing movement is performed by cutting off one of conduction between the normally-closed fixed contact unit and the movable contact and conduction between the common contact unit and the movable contact. Therefore, the resin carbonization caused by the arc discharge is not generated in one of the insulating region of the normally-closed fixed contact unit and the insulating region of the common contact unit. Thus, the insulation performance is improved because one of the insulating region of the normally-closed fixed contact unit and the insulating region of the common contact unit can be maintained in the clean region where the resin carbonization caused by the arc discharge is not generated.

Thus, according to one or more embodiments of the present invention, the switch in which the insulation failure is hardly generated can be fabricated.

In a switch according to one or more embodiments of the present invention, the normally-closed fixed contact unit differs from the common contact unit in a location of a boundary between the conductive region and the insulating region in the pressing direction.

In the case that the insulating region of the common contact unit is equal to the insulating region of the normally-closed fixed contact unit in a length of the pressing direction, the conduction between the normally-closed fixed contact unit and the movable contact is cut off every time the current opening and closing movement of the switch is performed at the same time as the cutoff of the conduction between the common contact unit and the movable contact. Therefore, there is a risk of maintaining one of the insulating region of the normally-closed fixed contact unit and the insulating region of the common contact unit in the clean region where the resin carbonization caused by the arc discharge is not generated.

According to one or more embodiments of the present invention, the normally-closed fixed contact unit differs from the common contact unit in the location of the boundary between the conductive region and the insulating region in the pressing direction, so that timing of cutting off the conduction between the common contact unit and the movable contact can surely be shifted from timing of cutting off the conduction between the normally-closed fixed contact unit and the movable contact during the current opening and closing movement. Thus, one of the insulating region of the normally-closed fixed contact unit and the insulating region of the common contact unit can be maintained in the clean region where the resin carbonization caused by the arc discharge is not generated.

In a switch according to one or more embodiments of the present invention, the normally-closed fixed contact unit and the common contact unit are disposed in parallel in a direction perpendicular to the pressing direction.

Accordingly, a configuration in which the movable contact configured to slide on both the normally-closed fixed contact unit and the common contact unit is simplified because the normally-closed fixed contact unit and the common contact unit are disposed in parallel in the direction perpendicular to the pressing direction.

In a switch according to one or more embodiments of the present invention, a removing unit extending in the pressing direction is formed in the insulating region of the normally-closed fixed contact unit, the removing unit configured to remove a metallic abrasion powder generated by sliding of the movable contact in the conductive region from the sliding surface of the movable contact.

According to one or more embodiments of the present invention, the metallic abrasion powder generated by the repetitive opening and closing movement of the switch is removed by the removing unit. As a result, the metallic abrasion powder deposited on the sliding surface of the movable contact in the normally-closed fixed contact unit is removed, so that the degradation of the insulation performance due to the metallic abrasion powder can be prevented.

A position where the removing unit is formed in the insulating region of the normally-closed fixed contact unit may be a position where the metallic abrasion powder is deposited. Both ends of the sliding region (in the direction perpendicular to the pressing direction) of the movable contact in the insulating region of the normally-closed fixed contact unit are cited as an example of the position where the removing unit is formed.

In a switch according to one or more embodiments of the present invention, the removing unit is a longitudinal groove extending in the pressing direction.

In accordance with one or more embodiments of the present invention, a switch includes: a normally-closed fixed contact unit; a common contact unit; a pressing member; and a movable contact that is attached to the pressing member and is configured to slide on the normally-closed fixed contact unit and the common contact unit. In the switch, a conductive region and a notch are sequentially formed toward a pressing direction of the pressing member in a portion in which the movable contact moves in the normally-closed fixed contact unit, the movable contact is configured to slide on the conductive region, and sliding on the normally-closed fixed contact unit is released in the notch to switch from a closed state to an opened state.

According to one or more embodiments of the present invention, the movable contact is configured to slide only on the conductive region in the normally-closed fixed contact unit during the opening and closing movement. The conductive region of the normally-closed fixed contact unit is in contact with the movable contact at a first position where the pressing operation is not performed.

When the pressing operation is further performed, the movable contact separates from the conductive region of the normally-closed fixed contact unit to enter a space formed by the notch at an operation position (OP). The movable contact is configured to slide on the conductive region of the normally-closed fixed contact unit, and the sliding on the normally-closed fixed contact unit is released in the notch. At the operation position, the contact between the normally-closed fixed contact unit and the movable contact is eliminated to cut off the conduction between the normally-closed fixed contact unit and the movable contact, thereby becoming the opened state (OFF state).

According to one or more embodiments of the present invention, in the OFF state, the movable contact does not slide on the insulating region made of the insulating resin, but is floated in the normally-closed fixed contact unit. Therefore, the insulation failure is hardly generated. Thus, the switch in which the insulation failure is hardly generated can be fabricated.

In a switch according to one or more embodiments of the present invention, an inclined surface is formed in an end portion on a conductive region side of the notch, the inclined surface configured to contact with the movable contact to guide the movable contact to the notch.

According to one or more embodiments of the present invention, because the inclined surface that contacts with the movable contact to guide the movable contact to the notch is formed in the end portion on the conductive region side of the notch, the movable contact is smoothly guided to the notch during the opening and closing movement of the switch. Therefore, deformation of the normally-closed fixed contact unit due to the movable contact can be prevented.

As described above, a switch according to one or more embodiments of the present invention may have a configuration in which the conductive region and the insulating region are formed are sequentially formed toward the pressing direction in the sliding surface of the movable contact in the common contact unit.

Additionally, as described above, the switch according to one or more embodiments of the present invention includes the normally-closed fixed contact unit, the common contact unit, the pressing member, and the movable contact that is attached to the pressing member and is configured to slide on the normally-closed fixed contact unit and the common contact unit. In the switch, the conductive region and the notch are sequentially formed toward the pressing direction of the pressing member in the portion in which the movable contact moves in the normally-closed fixed contact unit, the movable contact is configured to slide on the conductive region, and the sliding on the normally-closed fixed contact unit is released in the notch to switch from the closed state to the opened state.

Therefore, advantageously the switch in which the insulation failure is hardly generated can be fabricated.

BRIEF DESCRIPTION OF THE DRAWINGS

FIGS. 5A to 5C are front elevations illustrating the positional relationship between the slider and the normally-closed fixed contact unit and the common contact unit at each position during an opening and closing movement of the switch of the first embodiment, in which FIG. 5A is a front elevation illustrating the positional relationship in a free position (FP), FIG. 5B is a front elevation illustrating the positional relationship in an operation position (OP), and FIG. 5C is a front elevation illustrating the positional relationship in a transition-terminated position (TTP);

FIGS. 7A and 7B illustrate a state when the slider is located at the operation position (OP) in the normally-closed fixed contact unit in FIG. 6, in which FIG. 7A is a perspective view, and FIG. 7B is a side view;

FIGS. 8A and 8B illustrate a configuration of the normally-closed fixed contact unit of a switch according to a third embodiment of the present invention, in which FIG. 8A is a perspective view, and FIG. 8B is a top view.

DETAILED DESCRIPTION

First Embodiment

Figure 2:
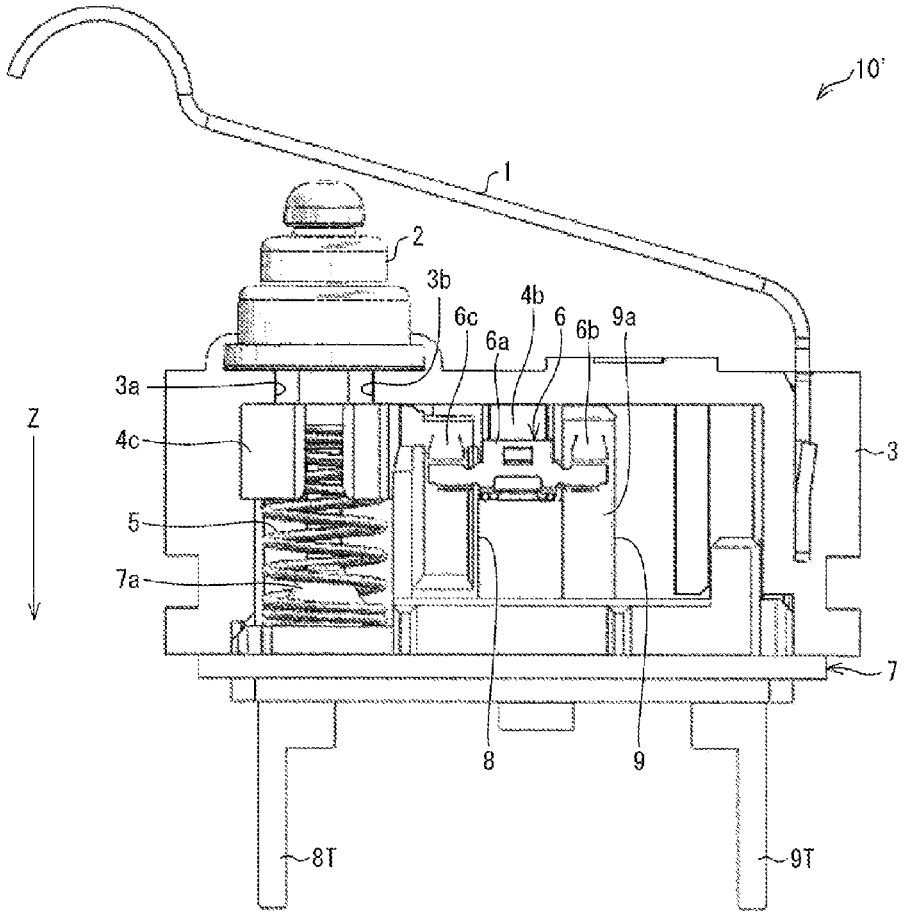
FIG. 2 is a view illustrating an internal configuration of a switch that is a precondition of the first embodiment.

Hereinafter, embodiments of the present invention will be described in detail. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. First, a configuration of a switch that is of a precondition of a first embodiment will be described with reference to FIG. 2. FIG. 2 is a view illustrating an internal configuration of a switch 10' that is the precondition of the first embodiment.

As illustrated in FIG. 2, the switch 10' includes a lever 1, a waterproof, dustproof rubber cap 2, an upper case 3, an operating member 4, a coil spring 5, a slider 6 that is of the movable contact, a case base 7, a normally-closed fixed contact unit 8, and a common contact unit 9. The upper case 3 is bonded to the case base 7 by laser welding. The upper case 3 and the case base 7 constitute an outer shape of the switch 10'. The upper case 3 and the case base 7 may be made of a material that is well known in the technical field of the switch. The lever 1 is attached to the upper case 3 so as to turn to press the operating member 4. At this point, it is assumed that a direction in which the operating member 4 is pressed is a Z-direction.

The coil spring 5, the slider 6, the normally-closed fixed contact unit 8, and the common contact unit 9 are provided in the upper case 3. The normally-closed fixed contact unit 8 and the common contact unit 9 are attached to the case base 7. A normally-closed terminal 8T for external connection and a common terminal 9T are connected to the normally-closed fixed contact unit 8 and the common contact unit 9.

The operating member 4 is retained in the upper case 3 while being movable in the Z-direction. The operating member 4 includes an operating unit 4*a*, a retaining unit 4*b*, and a spring retaining unit 4*c*. The lever 1 provides a pressing force to the operating unit 4*a*. The retaining unit 4*b* is provided integral with the operating unit 4*a* in a direction perpendicular to the Z-direction, and retains the slider 6. The spring retaining unit 4*c* is provided at a lower end in the Z-direction of the operating unit 4*a* of the operating member 4, and retains the coil spring 5. The operating member 4 may be made of a material that is well known in the technical field of the switch.

In the upper case 3, an upper end of the coil spring 5 is supported by the spring retaining unit 4*c* of the operating member 4, and a lower end of the coil spring is supported by a spring support 7*a* of the case base 7. The coil spring 5 is a biasing member that biases the pressed operating member 4 toward a first position (FP).

A guide hole 3*a* is made in the upper case 3. The operating unit 4*a* of the operating member 4 is inserted in the guide hole 3*a*. The guide hole 3*a* acts as a guide unit that guides the direction of a vertical movement associated with a switching movement in the operating unit 4*a* of the operating member 4 to the Z-direction.

An upper end portion of the operating unit 4*a* of the operating member 4 is coated with the rubber cap 2 for obtaining water-proof and dust proofing properties. The basic shape of the operating unit 4*a* of the operating member 4 is a columnar shape with the Z-direction as an axis, and a circular groove $4a_1$ with which the rubber cap 2 is engaged is formed near the upper end. In the rubber cap 2, an upper end unit 2*a* is engaged with the circular groove $4a_1$ of the operating unit 4*a*, and a lower end unit 2*b* is engaged with a circular projection 3*b* formed on the top of the upper case 3. The rubber cap 2 and the upper case 3 are bonded to each other by thermal caulking.

Figure 3:
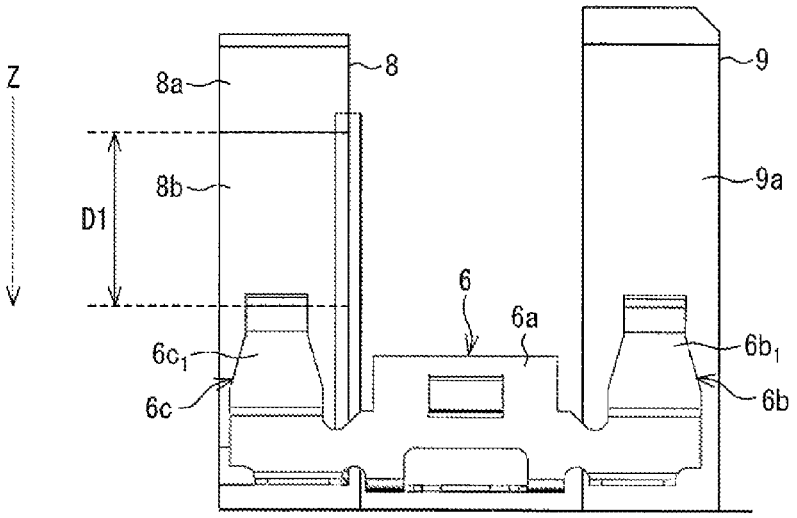
FIG. 3 is a front elevation illustrating a positional relationship between a slider and a normally-closed fixed contact unit and a common contact unit of the switch in FIG. 2.

The slider 6, the normally-closed fixed contact unit 8, and the common contact unit 9 will be described in detail below. FIG. 3 is a front elevation illustrating a positional relationship between the slider 6 and the normally-closed fixed contact unit 8 and the common contact unit 9 of the switch 10'.

For example, the slider 6 is formed by bending a metallic plate made of phosphor bronze. The slider 6 is retained by the retaining unit 4*b* of the operating member 4. The slider 6 includes a coupling 6*a* and movable contact units 6*b* and 6*c*. The movable contact unit 6*b* is formed at one of ends of the coupling 6*a*, and the movable contact unit 6*c* is formed at the other end of the coupling 6*a*. The movable contact unit 6*b* includes a first movable touch unit $6b_1$ and a second movable touch unit $6b_2$, and the first movable touch unit $6b_1$ and the second movable touch unit $6b_2$ constitute a clip that holds the common contact unit 9. The movable contact unit 6*c* has the same structure as the movable contact unit 6*b*, and includes a first movable touch unit $6c_1$ and a second movable touch unit $6c_2$. The first movable touch unit $6c_1$ and the second movable touch unit $6c_2$ constitute a clip that holds the normally-closed fixed contact unit 8. The movable contact unit 6*b* of the slider 6 retained by the retaining unit 4*b* of the operating member 4 contacts with the common contact unit 9 while clipping the common contact unit 9, and the movable contact unit 6*b* can slide in the Z-direction by the vertical movement of the operating member 4 associated with a turning movement of the lever 1. The movable contact unit 6*c* of the slider 6 retained by the retaining unit 4*b* of the operating member 4 contacts with the normally-closed fixed contact unit 8 while clipping the normally-closed fixed contact unit 8, and the movable contact unit 6*c* can slide in the Z-direction by the vertical movement of the operating member 4 associated with the turning movement of the lever 1.

The normally-closed fixed contact unit 8 is made of an insulating resin, and a part of a surface on which the slider 6 slides is subjected to metal plating. Therefore, a sliding surface of the slider 6 in the normally-closed fixed contact unit 8 is divided into a conductive region 8*a* made of metal and the insulating region 8*b* made of the insulating resin. As illustrated in FIG. 3, the conductive region 8*a* and the insulating region 8*b* are sequentially disposed in the Z-direction.

The common contact unit 9 is made of the insulating resin, and the surface on which the slider 6 slides is subjected to the metal plating. Therefore, a sliding surface of the slider 6 in the common contact unit 9 constitutes a conductive region 9*a* made of the metal.

A grease is applied to the sliding surfaces of the slider 6 in the normally-closed fixed contact unit 8 and the common contact unit 9 such that the slider 6 slides smoothly.

In the switch 10', when a pressing operation of the lever 1 is performed, the operating member 4 is pressed in the Z-direction. In conjunction with the pressing of the operating member 4, the movable contact units 6*b* and 6*c* of the slider 6 slide on the common contact unit 9 and the normally-closed fixed contact unit 8, respectively. The movable contact unit 6*c* of the slider 6 slides from the conductive region 8*a* to the insulating region 8*b* of the normally-closed fixed contact unit 8, whereby the switch 10' switches from a closed state to an opened state.

In the switch 10', during the opening and closing movement, the slider 6 slides to the conductive region 8*a* to the insulating region 8*b* of the normally-closed fixed contact unit 8. The conductive region 8*a* is abraded by the repetitive opening and closing movement, and metallic abrasion powders are deposited on the conductive region 8*a* and the insulating region 8*b* (see FIG. 9). As a result, insulation performance of the switch 10' degrades to generate an insulation failure. An arc discharge is generated between the normally-closed fixed contact unit 8 and the slider 6 in the case of the opening and closing operation of a high-capacity current. The insulating resin or the grease, which constitutes the insulating region 8*b*, is carbonized, and therefore the insulation performance of the switch 10' degrades to generate the insulation failure.

Figure 1:
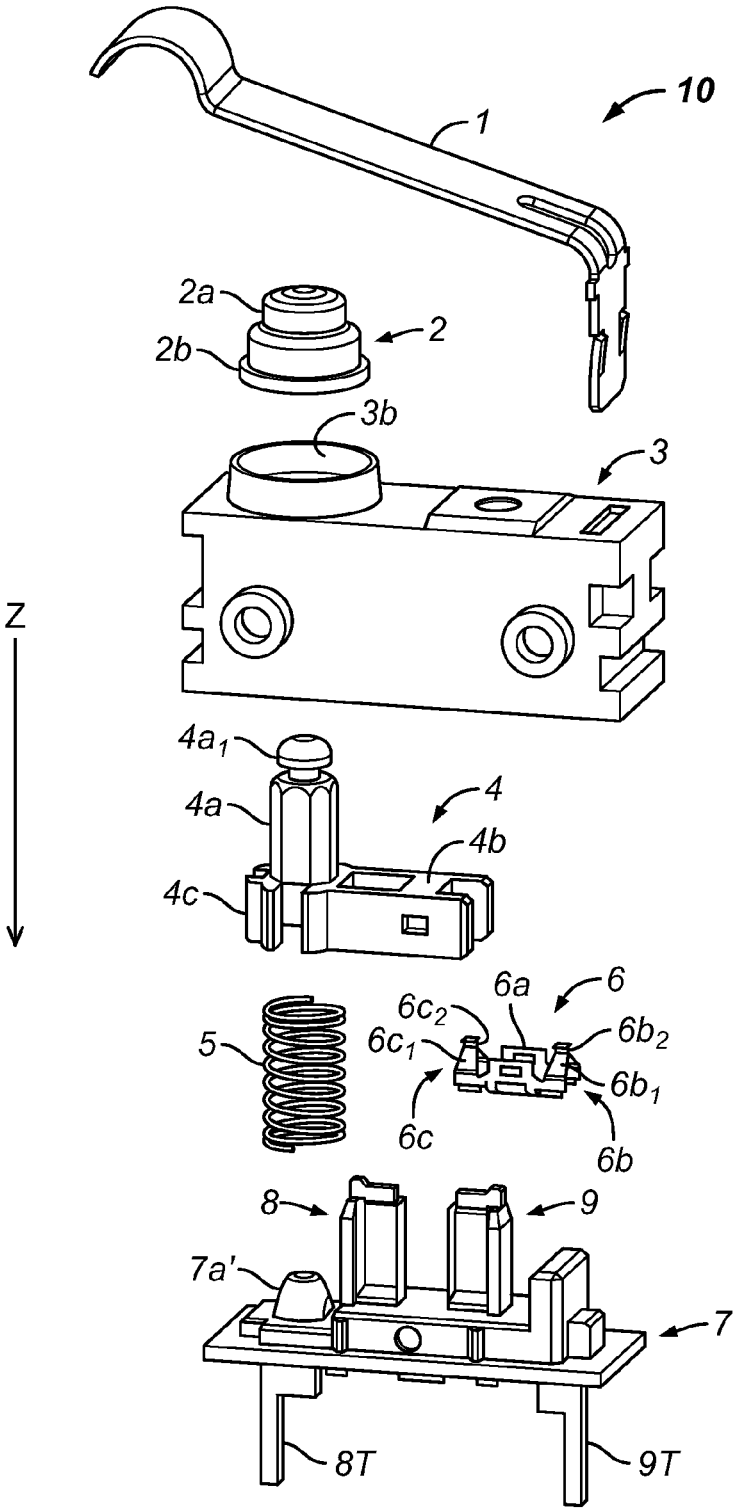
FIG. 1 is an exploded perspective view illustrating a configuration of a switch according to a first embodiment of the present invention.
Figure 4:
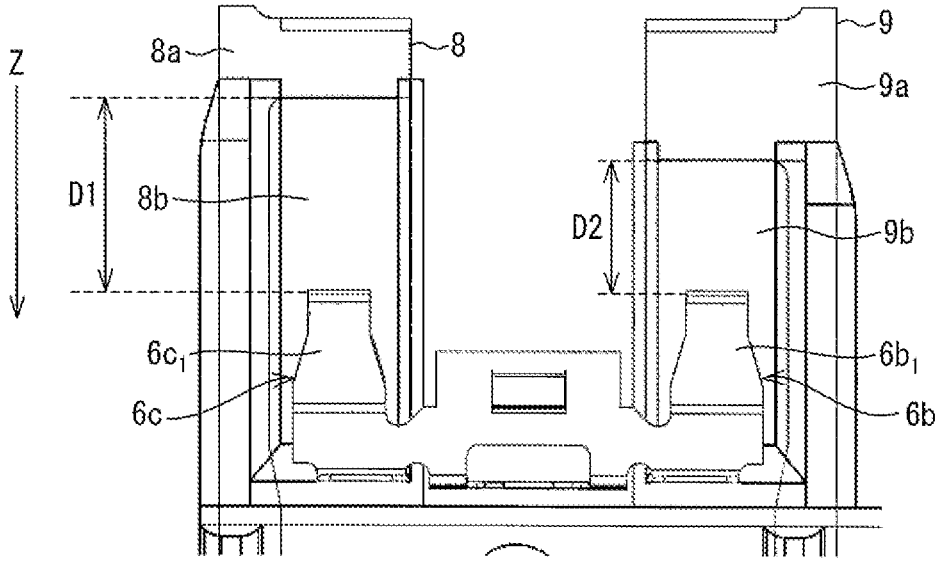
FIG. 4 is a front elevation illustrating the positional relationship between the slider and the normally-closed fixed contact unit and the common contact unit of the switch of the first embodiment.

A switch 10 of the first embodiment has a structure in which the insulation failure is hardly generated. FIG. 1 is an exploded perspective view illustrating a configuration of the switch 10 of the first embodiment. FIG. 4 is a front elevation illustrating the positional relationship between the slider 6 and the normally-closed fixed contact unit 8 and the common contact unit 9 of the switch 10.

As illustrated in FIGS. 1 and 4, the common contact unit 9 is made of the insulating resin, and part of the surface on which the movable contact unit 6*b* of the slider 6 slides is subjected to the metal plating. Therefore, the sliding surface of the slider 6 in the common contact unit 9 is divided into the conductive region 9*a* made of the metal and an insulating region 9*b* made of the insulating resin. As illustrated in FIGS. 1 and 4, in the switch 10 of the first embodiment, the conductive region 9*a* and the insulating region 9*b* are sequentially formed in the Z-direction in the sliding surface of the movable contact unit 6*b* in the common contact unit 9. In the Z-direction, the insulating region 9*b* of the common contact unit 9 is shorter than the insulating region 8*b* of the normally-closed fixed contact unit 8.

Figure 5A:
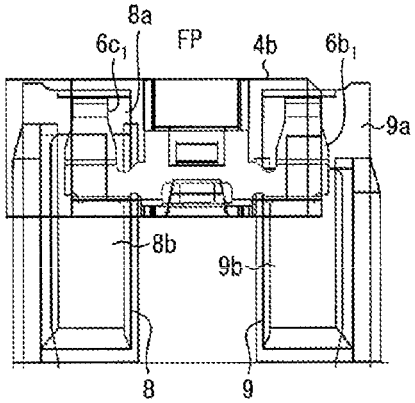
Figure 5B:
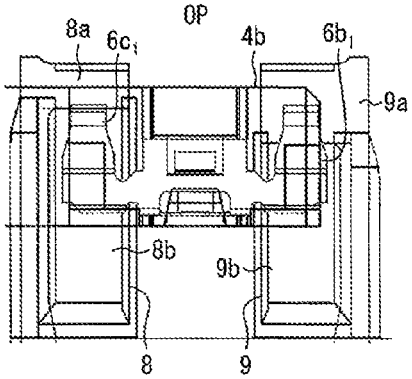
Figure 5C:
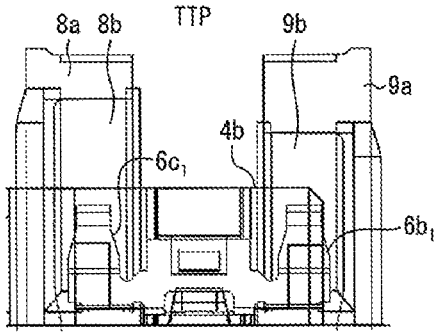

The opening and closing movement of the switch 10 of the first embodiment will be described below with reference to FIGS. 5A to 5C. FIGS. 5A to 5C illustrate the positional relationship between the slider 6 and the normally-closed fixed contact unit 8 and the common contact unit 9 at each position during an opening and closing movement. FIG. 5A is a front elevation illustrating the positional relationship in a free position (FP), FIG. 5B is a front elevation illustrating the positional relationship in an operation position (OP), and FIG. 5C is a front elevation illustrating the positional relationship in a transition-terminated position (TTP).

When the lever 1 is retained at the first position (free position (FP)) where the pressing operation is not performed, the operating member 4 is pushed up by the biasing force of the coil spring 5, and an upper surface of the retaining unit 4*b* of the operating member 4 is latched in an inner wall surface on the upper side of the upper case 3. At this point, as illustrated in FIG. 5A, in the normally-closed fixed contact unit 8, the conductive region 8*a* is clipped between the first movable touch unit $\mathbf{6}c_1$ and the second movable touch unit $\mathbf{6}c_2$ of the movable contact unit 6*c* in the slider 6. In the common contact unit 9, the conductive region 9*a* is clipped between the first movable touch unit $\mathbf{6}b_1$ and the second movable touch unit $\mathbf{6}b_2$ of the movable contact unit 6*b* in the slider 6. That is, at the free position (FP), the conduction between the normally-closed fixed contact unit 8 and the common contact unit 9 is established through the slider 6 to turn to the closed state (ON state).

When the pressing operation of the lever 1 is performed from the closed state, the pressing force of the lever 1 is provided to the operating unit 4*a* of the operating member 4, and the operating member 4 moves in the Z-direction by the operating unit 4*a*. Therefore, the slider 6 retained by the retaining unit 4*b* of the operating member 4 slides on the normally-closed fixed contact unit 8 and the common contact unit 9 against the biasing force of the coil spring 5. At this point, as illustrated in FIG. 5B, the first movable touch unit $\mathbf{6}c_1$ of the movable contact unit 6*c* in the slider 6 separates from the conductive region 8*a* of the normally-closed fixed contact unit 8 and contacts with the insulating region 8*b*. Therefore, at the operation position (OP), the conduction between the conduction normally-closed fixed contact unit 8 and the slider 6 is cut off to turn to the opened state (OFF state). Then, the first movable touch unit $\mathbf{6}b_1$ of the movable contact unit 6*b* in the slider 6 separates from the conductive region 9*a* of the common contact unit 9, and the first movable touch unit $\mathbf{6}c_1$ contacts with insulating region 8*b* and contacts with the insulating region 9*b*. Therefore, the conduction between the common contact unit 9 and the slider 6 is cut off after the opened state (OFF state).

When the pressing operation of the lever 1 is completely performed, as illustrated in FIG. 5C, the first movable touch unit $\mathbf{6}c_1$ and the first movable touch unit $\mathbf{6}b_1$ reach the lower ends (that is, transition-terminated position (TTP)) of the insulating region 8*b* and the insulating region 9*b* while contacting with the insulating region 8*b* of the normally-closed fixed contact unit 8 and the insulating region 9*b* of the common contact unit 9.

When the pressing force provided to the lever 1 is removed, the operating member 4 returns to the first position (free position (FP)) by the biasing force of the coil spring 5. At this point, as described above, the conduction between the normally-closed fixed contact unit 8 and the common contact unit 9 is established through the slider 6 to turn to the closed state (ON state) (see FIG. 5A).

In the switch 10', the insulation distance necessary to close the circuit is a sliding distance D1 of the slider 6 in the insulating region 8*b* of the normally-closed fixed contact unit 8 (see FIG. 3). On the other hand, in the switch 10 of the first embodiment, the insulation distance is a distance in which a sliding distance D2 of the slider 6 in the insulating region 9*b* of the common contact unit 9 is added to the sliding distance D1 of the slider 6 in the insulating region 8*b* of the normally-closed fixed contact unit 8 (see FIG. 4). That is, in the switch 10, the insulation distance is longer than that of the switch 10' by the sliding distance D2 of the slider 6 in the insulating region 9*b* of the common contact unit 9. Therefore, compared with the switch 10', the insulation performance is improved and the insulation failure is hardly generated.

In the switch 10', as illustrated in FIG. 3, because the insulating region 8*b* is formed only in the normally-closed fixed contact unit 8, the current opening and closing movement is performed by cutting off only the conduction between the normally-closed fixed contact unit 8 and the slider 6.

On the other hand, in the switch 10 of the first embodiment, the conduction between the normally-closed fixed contact unit 8 and the slider 6 and the conduction between the common contact unit 9 and the slider 6 are cut off as illustrated in FIG. 5B. The current opening and closing movement is performed by cutting off the conduction between the normally-closed fixed contact unit 8 and the slider 6. That is, in the switch 10 of the first embodiment, because the current opening and closing movement is not performed by passage of the slider 6 through the insulating region 9*b* on the side of the common contact unit 9, the resin carbonization caused by the arc discharge is not generated in the insulating region 9*b* on the side of the common contact unit 9. Therefore, the insulation performance is improved because the insulating region 9*b* on the side of the common contact unit 9 can be maintained in the clean region where the resin carbonization is not generated.

According to the switch 10 of the first embodiment, even if the arc discharge is generated between the normally-closed fixed contact unit 8 and the slider 6, the current opening and closing movement can be performed by cutting off the conduction between the common contact unit 9 and the slider 6. Therefore, the insulation performance is improved.

According to the switch 10 of the first embodiment, in the Z-direction, the insulating region 9*b* of the common contact unit 9 is shorter than the insulating region 8*b* of the normally-closed fixed contact unit 8. This enables the conduction between the normally-closed fixed contact unit 8 and the slider 6 to be surely cut off prior to the cutoff of the conduction between the common contact unit 9 and the slider 6 during the current opening and closing movement. Therefore, the insulating region 9*b* on the side of the common contact unit 9 can surely be maintained in the clean region where the resin carbonization is not generated. In the case that the insulating region 9*b* of the common contact unit 9 is substantially equal to the insulating region 8*b* of the normally-closed fixed contact unit 8 in the length of the Z-direction, the conduction between the normally-closed fixed contact unit 8 and the slider 6 is cut off every time the current opening and closing movement of the switch 10 is performed at the same time as the cutoff of the conduction between the common contact unit 9 and the slider 6, and there is a risk that the insulating region 9*b* on the side of the common contact unit 9 cannot be maintained in the clean region where the resin carbonization is not generated.

The switch 10 of the first embodiment may be configured such that one of the conduction between the normally-closed fixed contact unit 8 and the slider 6 and the conduction between the common contact unit 9 and the slider 6 is cut off during the current opening and closing movement. Therefore, the switch 10 of the first embodiment may be configured such that the insulating region 9*b* of the common contact unit 9 is longer than the insulating region 8*b* of the normally-closed fixed contact unit 8 in the Z-direction.

The configuration of the switch 10 of the first embodiment is summarized as follows.

The switch 10 of the first embodiment includes the normally-closed fixed contact unit 8, the common contact unit 9, the operating member 4, and the slider 6 that is attached to the operating member 4 to slide on both the normally-closed fixed contact unit 8 and the common contact unit 9. The conductive region 8*a* and the insulating region 8*b* are sequentially formed toward the pressing direction (Z-direction) of the operating member 4 in the sliding surface of the slider 6 in the normally-closed fixed contact unit 8. The slider 6 slides from the conductive region 8*a* to the insulating region 8*b* to switch from the closed state to the opened state. In the switch 10, the conductive region 9*a* and the insulating region 9*b* are sequentially formed toward the Z-direction in the sliding surface of the slider 6 in the common contact unit 9.

According to the configuration of the switch 10 of the first embodiment, the conductive region 8*a* and the insulating region 8*b* are sequentially formed toward the pressing direction (Z-direction) of the operating member in the sliding surface of the slider 6 in the normally-closed fixed contact unit 8, and the conductive region 9*a* and the insulating region 9*b* are sequentially formed toward the Z-direction in the sliding surface of the slider 6 in the common contact unit 9. Therefore, the insulation distance necessary to close the circuit is the distance in which the sliding distance of the slider 6 in the insulating region 8*b* of the normally-closed fixed contact unit 8 is added to the sliding distance of the slider 6 in the insulating region 9*b* of the common contact unit 9. That is, in the switch 10 of the first embodiment, the insulation distance can be lengthened by the sliding distance of the slider 6 in the insulating region 9*b* of the common contact unit 9 when compared with the conventional switch. Therefore, when compared with the conventional switch, the insulation performance is improved and the insulation failure is hardly generated.

According to the switch 10 of the first embodiment, the current opening and closing movement is performed by cutting off one of the conduction between the normally-closed fixed contact unit 8 and slider 6 and the conduction between the common contact unit 9 and the slider 6. Therefore, the resin carbonization caused by the arc discharge is not generated in one of the insulating region 8*b* of the normally-closed fixed contact unit 8 and the insulating region 9*b* of the common contact unit 9. Accordingly, the insulation performance is improved because one of the insulating region 8*b* of the normally-closed fixed contact unit 8 and the insulating region 9*b* of the common contact unit 9 can be maintained in the clean region where the resin carbonization caused by the arc discharge is not generated.

Thus, according to the switch 10 of the first embodiment, the switch in which the insulation failure is hardly generated can be fabricated.

In a switch 10 according to one or more embodiments of the present invention, the location of a boundary between the conductive region 8*a* and the insulating region 8*b* of the normally-closed fixed contact unit 8 differs from the location of a boundary between the conductive region 9*a* and the insulating region 9*b* of the common contact unit 9 in the Z-direction.

In the case that the insulating region 9*b* of the common contact unit 9 is substantially equal to the insulating region 8*b* of the normally-closed fixed contact unit 8 in the length of the Z-direction, the conduction between the normally-closed fixed contact unit 8 and the slider 6 is cut off every time the current opening and closing movement of the switch is performed at the same time as the cutoff of the conduction between the common contact unit 9 and the slider 6. Therefore, there is a risk that one of the insulating region 8*b* of the normally-closed fixed contact unit 8 and the insulating region 9*b* of the common contact unit 9 cannot be maintained in the clean region where the resin carbonization caused by the arc discharge is not generated.

According to the switch 10 of the first embodiment, the location of the boundary between the conductive region 8*a* and the insulating region 8*b* of the normally-closed fixed contact unit 8 differs from the location of the boundary between the conductive region 9*a* and the insulating region 9*b* of the common contact unit 9 in the Z-direction, so that timing of cutting off the conduction between the common contact unit 9 and the slider 6 can surely be shifted from timing of cutting off the conduction between the normally-closed fixed contact unit 8 and the slider 6 during the current opening and closing movement. Therefore, according to the switch 10 of the first embodiment, one of the insulating region 8*b* of the normally-closed fixed contact unit 8 and the insulating region 9*b* of the common contact unit 9 can be maintained in the clean region where the resin carbonization caused by the arc discharge is not generated.

In a switch 10 according to one or more embodiments of the present invention, the normally-closed fixed contact unit 8 and the common contact unit 9 are disposed in parallel in the direction perpendicular to the Z-direction.

According to the switch 10 of the first embodiment, the configuration in which the slider 6 slides on both the normally-closed fixed contact unit 8 and the common contact unit 9 can be simplified, because the normally-closed fixed contact unit 8 and the common contact unit 9 are disposed in parallel in the direction perpendicular to the Z-direction.

Second Embodiment

A second embodiment of the present invention will be described below with reference to FIGS. 6 and 7. For the sake of convenience, the component having the same function as that of the first embodiment is designated by the same numeral, and the description is neglected.

In the switch 10 of the first embodiment, not only on the side of the normally-closed fixed contact unit 8, the insulating region 9*b* is also provided on the side of the common contact unit 9 to improve the insulation performance. On the other hand, in the switch 10 of the second embodiment, a notch 8*c* is provided in the normally-closed fixed contact unit 8 to improve the insulation performance. FIG. 6 is a photograph illustrating configurations of the normally-closed fixed contact unit 8 and the common contact unit 9 of the switch 10 of the second embodiment.

Figure 6:
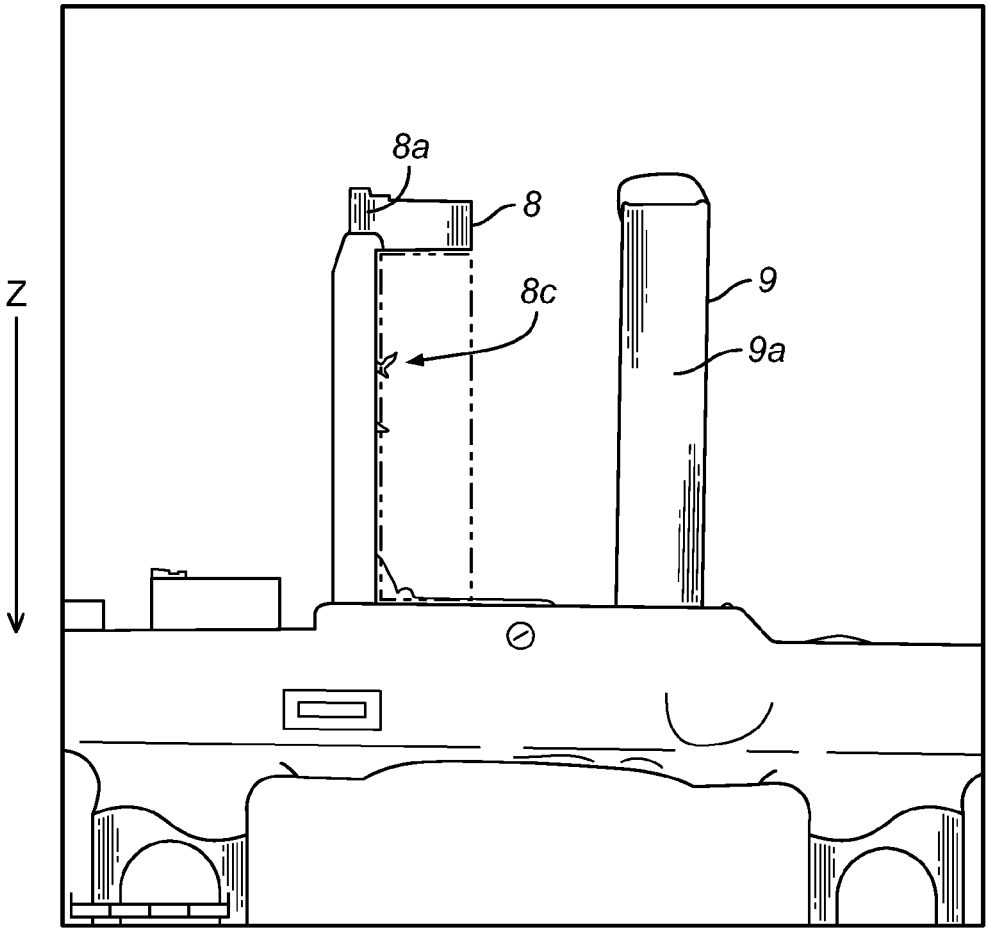
FIG. 6 is a photograph illustrating configurations of the normally-closed fixed contact unit and the common contact unit of a switch according to a second embodiment of the present invention.

As illustrated in FIG. 6, in the switch 10 of the second embodiment, the normally-closed fixed contact unit 8 includes the notch 8*c*. The notch 8*c* is formed immediately below the conductive region 8*a* in the Z-direction. That is, the conductive region 8*a* and the notch 8*c* are sequentially formed toward the Z-direction in the portion in which the slider 6 is moved in the normally-closed fixed contact unit 8. The conductive region 9*a* made of the metal constitutes the sliding surface of the slider 6 in the common contact unit 9.

In the switch 10 of the second embodiment, the movable contact unit 6*c* of the slider 6 slides only on the conductive region 8*a* of the normally-closed fixed contact unit 8 during the opening and closing movement. At the first position (free position (FP)) where the pressing operation of the lever 1 is not performed, the conductive region 8*a* of the normally-closed fixed contact unit 8 is clipped between the first movable touch unit $\mathbf{6}c_1$ and the second movable touch unit $\mathbf{6}c_2$ of the movable contact unit 6*c* in the slider 6.

Figure 7A:
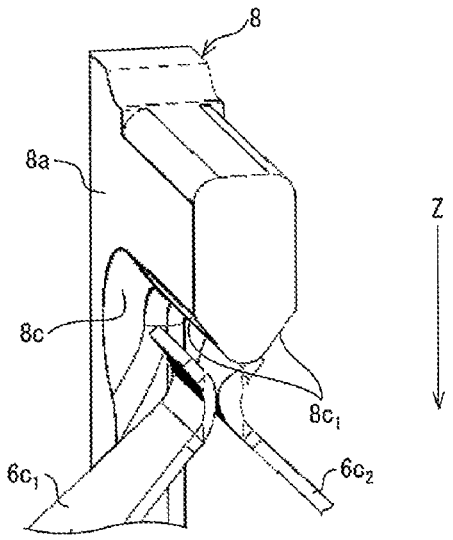
Figure 7B:
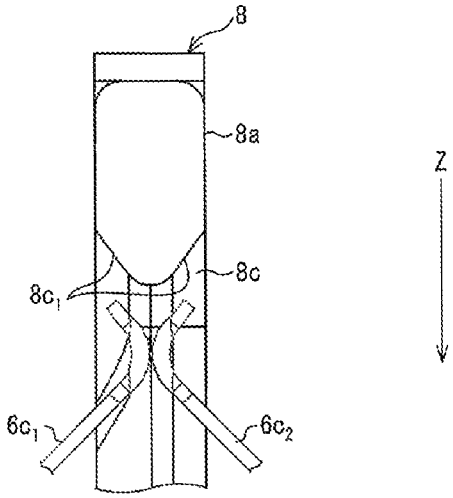

When the pressing operation of the lever 1 is further performed, at the operation position (OP), the first movable touch unit $\mathbf{6}c_1$ and the second movable touch unit $\mathbf{6}c_2$ of the movable contact unit 6*c* separate from the conductive region 8*a* of the normally-closed fixed contact unit 8 to enter a space formed by the notch 8*c*. FIGS. 7A and 7B illustrate the state when the first movable touch unit $\mathbf{6}c_1$ and the second movable touch unit $\mathbf{6}c_2$ of the movable contact unit 6*c* is located at the operation position (OP), in which FIG. 7A is a perspective view, and FIG. 7B is a side view.

As illustrated in FIGS. 7A and 7B, the first movable touch unit $\mathbf{6}c_1$ and the second movable touch unit $\mathbf{6}c_2$ contact with each other because nothing is clipped therebetween. Thus, according to the switch 10 of the second embodiment, the slider 6 slides on the conductive region 8*a* in the normally-closed fixed contact unit 8, and the sliding on the normally-closed fixed contact unit 8 is released in the notch 8*c*. The first movable touch unit $\mathbf{6}b_1$ and the second movable touch unit $\mathbf{6}b_2$ are maintained in the state in which the first movable touch unit $\mathbf{6}b_1$ and the second movable touch unit $\mathbf{6}b_2$ contact with the conductive region 9*a* of the common contact unit 9. Therefore, at the operation position (OP), the contact between the normally-closed fixed contact unit 8 and the slider 6 is eliminated, and the conduction between the normally-closed fixed contact unit 8 and the slider 6 is cut off to turn to the opened state (OFF state).

According to the switch 10 of the second embodiment, the slider 6 does not slide on the insulating region made of the insulating resin, but is floated in the OFF state. Therefore, the insulation failure is hardly generated.

A tapered surface $\mathbf{8}c_1$ is formed in an end portion of the notch 8*c* on the side of the conductive region 8*a* so as to contact with the first movable touch unit $\mathbf{6}c_1$ and the second movable touch unit $\mathbf{6}c_2$ of the slider 6 to guide the first movable touch unit $\mathbf{6}c_1$ and the second movable touch unit $\mathbf{6}c_2$ to the notch 8*c*. As illustrated in FIGS. 7A and 7B, the tapered surface $\mathbf{8}c_1$ projects in the Z-direction. Therefore, during the opening and closing movement of the switch 10, the first movable touch unit $\mathbf{6}c_1$ and the second movable touch unit $\mathbf{6}c_2$ are smoothly guided to the notch 8*c*, so that deformation of the normally-closed fixed contact unit 8 can be prevented.

The configuration of the switch 10 of the second embodiment is summarized as follows.

The switch 10 of the second embodiment includes the normally-closed fixed contact unit 8, the common contact unit 9, the operating member 4, and the slider 6 that is of the movable contact attached to the operating member 4 to slide on both the normally-closed fixed contact unit 8 and the common contact unit 9. The conductive region 8*a* and the notch 8*c* are sequentially formed toward the pressing direction (Z-direction) of the operating member 4 in the portion in which the slider 6 is moved in the normally-closed fixed contact unit 8, the slider 6 slides on the conductive region 8*a*, and the sliding on the normally-closed fixed contact unit 8 is released in the notch 8*c*, thereby switching from the closed state to the opened state.

According to the switch 10 of the second embodiment, during the opening and closing movement, the slider 6 slides only on the conductive region 8*a* in the normally-closed fixed contact unit 8. At the first position where the pressing operation is not performed, the conductive region 8*a* of the normally-closed fixed contact unit 8 is in contact with the slider 6.

When the pressing operation is further performed, at the operation position (OP), the slider 6 separates from the conductive region 8*a* of the normally-closed fixed contact unit 8 to enter the space formed by the notch 8*c*. The slider 6 slides on the conductive region 8*a* of the normally-closed fixed contact unit 8, and the sliding on the normally-closed fixed contact unit 8 is released in the notch 8*c*. Therefore, at the operation position, the contact between the normally-closed fixed contact unit 8 and the slider 6 is eliminated, and the conduction between the normally-closed fixed contact unit 8 and the slider 6 is cut off to turn to the opened state (OFF state).

According to the switch 10 of the second embodiment, in the OFF state, the slider 6 does not slide on the insulating region made of the insulating resin, but is floated in the normally-closed fixed contact unit 8. Therefore, the insulation failure is hardly generated. Accordingly, in the switch 10 of the second embodiment, the switch in which the insulation failure is hardly generated can be fabricated.

In a switch 10 according to one or more embodiments of the present invention, the tapered surface 8$c_1$ that is of the inclined surface is formed in the end portion of the notch 8*c* on the side of the conductive region 8*a* so as to contact with the slider 6 to guide the slider 6 to the notch 8*c*.

According to the switch 10 of the second embodiment, because the tapered surface 8$c_1$ that is of the inclined surface is formed in the end portion of the notch 8*c* on the side of the conductive region 8*a* so as to contact with the slider 6 to guide the slider 6 to the notch 8*c*, the slider 6 is smoothly guided to the notch 8*c* during the opening and closing movement of the switch. Therefore, in the switch 10 of the second embodiment, the deformation of the normally-closed fixed contact unit 8 due to the slider 6 can be prevented.

Third Embodiment

Figure 8A:
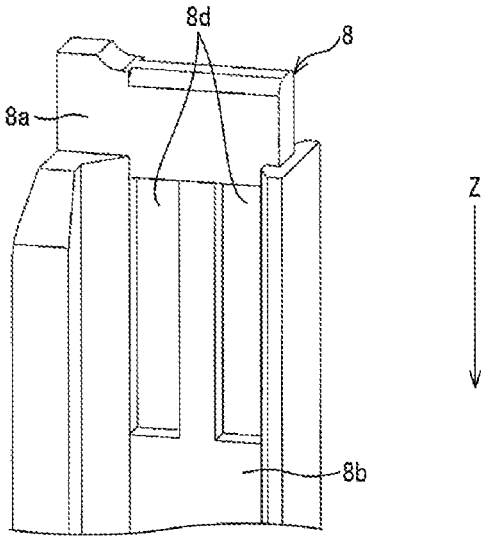
Figure 8B:
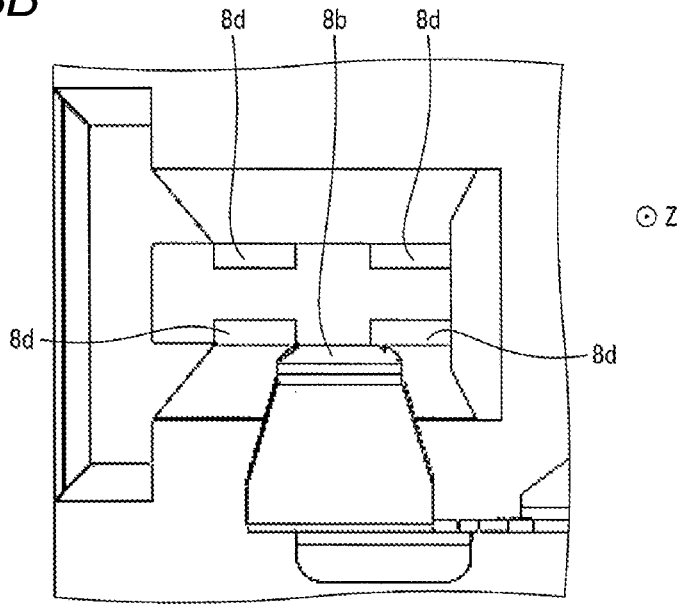

A third embodiment of the present invention will be described below with reference to FIGS. 8A and 8B. For the sake of convenience, the component having the same function as that of the first and second embodiments is designated by the same numeral, and the description is neglected.

Figure 9:
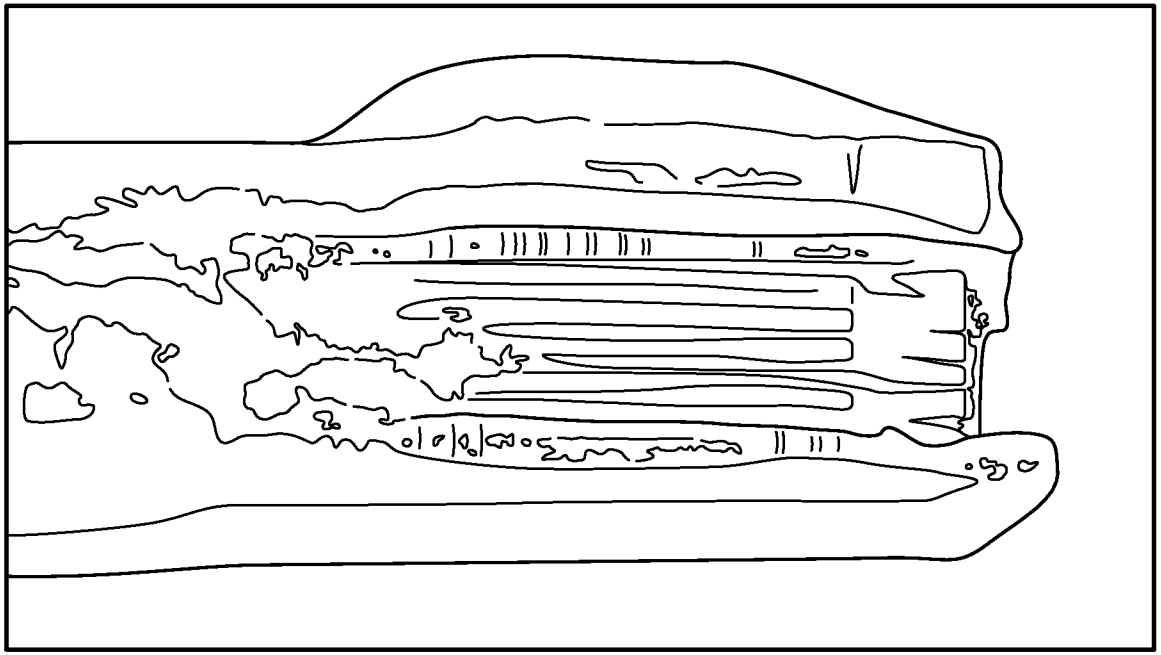
FIG. 9 is a photograph illustrating metallic abrasion powders deposited on a sliding surface of the slider of the normally-closed fixed contact unit by the opening and closing movement of the switch in FIG. 1.

One of the feature of the switch 10 of the third embodiment is that a longitudinal groove 8*d* extending in the Z-direction is formed in the insulating region 8*b* of the normally-closed fixed contact unit 8. FIGS. 8A and 8B illustrate a configuration of the normally-closed fixed contact unit 8 of the switch 10 of the third embodiment, in which FIG. 8A is a perspective view, and FIG. 8B is a top view. FIG. 9 is a photograph illustrating the metallic abrasion powders deposited on the sliding surface of the slider 6 of the normally-closed fixed contact unit 8 by the opening and closing movement of the switch 10 in FIG. 1.

As illustrated in FIG. 9, the metallic abrasion powders are deposited on the sliding surface of the slider 6 in the normally-closed fixed contact unit 8 by the repetitive opening and closing movement of the switch 10. In the sliding surface of the slider 6, the metallic abrasion powders are deposited at both ends in the direction perpendicular to the Z-direction in the sliding region (the region on which the first movable touch unit 6$c_1$ and the second movable touch unit 6$c_2$ of the movable contact unit 6*c* slide) on which the slider 6 slides.

In the switch 10 of the third embodiment, the longitudinal grooves 8*d* extending in the Z-direction are formed at both ends of the sliding region on which the slider 6 slides in the insulating region 8*b*. The longitudinal grooves 8*d* act as the removing unit that removes the metallic abrasion powders generated by the sliding of the slider 6 in the conductive region 8*a* from the sliding surface of the slider 6.

In the switch 10 of the third embodiment, the metallic abrasion powders generated by the repetitive opening and closing movement of the switch 10 fall in the longitudinal grooves 8*d*. As a result, the metallic abrasion powders deposited on the sliding surface of the slider 6 in the normally-closed fixed contact unit 8 are removed, so that the degradation of the insulation performance due to the metallic abrasion powders can be prevented.

In the switch 10 of the third embodiment, the configuration of the removing unit that removes the metallic abrasion powders is not limited to the longitudinal groove 8*d* extending in the Z-direction. Any configuration in which the metallic abrasion powders are removed may be used. For example, the removing unit may be constructed by a longitudinal hole which extends in the Z-direction at both ends of the sliding region on which the slider 6 slides in the insulating region 8*b* and pierces the normally-closed fixed contact unit 8.

The configuration of the switch 10 of the third embodiment is summarized as follows.

In a switch 10 according to one or more embodiments of the present invention, the longitudinal groove 8*d* extending in the Z-direction is formed in the insulating region 8*b* of the normally-closed fixed contact unit 8 as the removing unit that removes the metallic abrasion powders from the sliding surface of the slider 6 generated by the sliding of the slider 6 in the conductive region 8*a*.

According to the switch 10 of the third embodiment, the metallic abrasion powders generated by the repetitive opening and closing movement of the switch 10 are removed by the removing unit. As a result, in the switch 10 of the third embodiment, the metallic abrasion powders deposited on the sliding surface of the slider 6 in the normally-closed fixed contact unit 8 are removed, so that the degradation of the insulation performance due to the metallic abrasion powders can be prevented.

The position where the removing unit is formed in the insulating region 8*b* of the normally-closed fixed contact unit 8 may be the position where the metallic abrasion powders are deposited. Both ends of the sliding region (in the direction perpendicular to the Z-direction) of the slider 6 in the insulating region 8*b* of the normally-closed fixed contact unit 8 are cited as an example of the position where the removing unit is formed.

In the switch 10 of the third embodiment, the removing unit may be the longitudinal groove 8*d* extending in the Z-direction.

The present invention is not limited to the above embodiments, but various modifications can be made without departing from the scope of the invention. Embodiment obtained by properly combining technical means disclosed in the embodiment is also included in the technical scope of the invention.

INDUSTRIAL APPLICABILITY

For example, one or more embodiments of the present invention can suitably be applied to the switch that detects a locked state or an unlocked state of an in-vehicle door.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A switch comprising:

a normally-closed fixed first contact unit;

a second contact unit;

a pressing member; and a movable contact that is attached to the pressing member, and that slides on the first contact unit and the second contact unit, wherein a first conductive region and a first insulating region are formed on a first sliding surface, on which the movable contact slides, in the first contact unit, wherein the first conductive region is arranged before the first insulating region in a pressing direction of the pressing member, wherein a second conductive region and a second insulating region are formed on a second sliding surface, on which the movable contact slides, in the second contact unit, wherein the second conductive region is arranged before the second insulating region in the pressing direction, wherein the movable contact slides from the first and second conductive regions to the first and second insulating regions to switch from a closed state in which conduction between the first contact unit and the second contact unit is established, to an opened state in which conduction between the first contact unit and the second contact unit is cut off, wherein a first boundary between the first conductive region and the first insulating region in the pressing direction is offset in the pressing direction from a second boundary region between the second conductive region and the second insulating region in the pressing direction.

2. The switch according to claim 1, wherein the first contact unit and the second contact unit are disposed in parallel in a direction perpendicular to the pressing direction.

3. The switch according to claim 2, wherein a removing unit extending in the pressing direction is formed on the insulating region of the first contact unit, and wherein the removing unit is a longitudinal groove extending in the pressing direction to remove a metallic abrasion powder generated by sliding of the movable contact in the conductive region from the sliding surface, on which the movable contact slides.

4. The switch according to claim 1, wherein a removing unit extending in the pressing direction is formed on the insulating region of the first contact unit, and wherein the removing unit is a longitudinal groove extending in the pressing direction to remove a metallic abrasion powder generated by sliding of the movable contact in the conductive region from the sliding surface, on which the movable contact slides.

5. A switch comprising:

a normally-closed fixed first contact unit;

a second contact unit;

a pressing member; and a movable contact that is attached to the pressing member and that slides on the first contact unit and the second contact unit, wherein a conductive region and a notch are sequentially formed in a pressing direction of the pressing member on a portion in which the movable contact moves in the first contact unit, wherein the movable contact slides on the conductive region, and wherein sliding on the first contact unit is completely released in the notch to switch from a closed state in which conduction between the first contact unit and the second contact unit is established, to an opened state in which conduction between the first contact unit and the second contact unit is cut off.

6. The switch according to claim 5, wherein an inclined surface is formed on an end portion on a side of the conductive region of the notch, and wherein the inclined surface contacts with the movable contact to guide the movable contact to the notch.

* * * * *